US012383813B1

(12) United States Patent
Puryear

(10) Patent No.: US 12,383,813 B1
(45) Date of Patent: Aug. 12, 2025

(54) MAGNETIC GOLF GLOVE WITH BALL MARKER

(71) Applicant: Chase Puryear, Florence, AL (US)

(72) Inventor: Chase Puryear, Florence, AL (US)

( * ) Notice: Subject to any disclaimer, the term of this patent is extended or adjusted under 35 U.S.C. 154(b) by 0 days.

(21) Appl. No.: 18/653,013

(22) Filed: May 2, 2024

(51) Int. Cl.

| | |
|---|---|
| ***A63B 71/14*** | (2006.01) |
| ***A41D 19/00*** | (2006.01) |
| ***A41F 1/06*** | (2006.01) |
| ***A63B 57/35*** | (2015.01) |

(52) U.S. Cl.
CPC ..... *A63B 71/146* (2013.01); *A41D 19/0024* (2013.01); *A41D 19/0037* (2013.01); *A41F 1/06* (2013.01); *A63B 57/35* (2015.10)

(58) Field of Classification Search
CPC .. A63B 71/146; A63B 57/35; A41D 19/0024; A41D 19/0048; A41D 19/0034; A41D 19/0037; A41D 19/01594; A41D 19/0017; A41F 1/06; A41F 1/002
USPC ..... 2/161.2, 161.3, 161.4
See application file for complete search history.

(56) References Cited

U.S. PATENT DOCUMENTS

| | | | | |
|---|---|---|---|---|
| 5,898,943 | A | 5/1999 | Kim | |
| 5,996,116 | A * | 12/1999 | Tate | A63B 57/207 2/200.1 |
| 6,014,775 | A | 1/2000 | Missry | |
| 6,052,828 | A | 4/2000 | Widdemer | |
| 6,513,165 | B1 | 2/2003 | England et al. | |
| 6,519,776 | B1 * | 2/2003 | Davenport | A63B 57/207 2/161.1 |
| 6,820,282 | B1 | 11/2004 | England et al. | |
| 7,784,112 | B2 * | 8/2010 | Shwartz | A63B 57/353 2/161.1 |
| 8,510,866 | B2 | 8/2013 | Mizumoto | |
| 9,138,624 | B2 | 9/2015 | Maugham | |
| 11,133,122 | B2 * | 9/2021 | Vazquez | A44B 99/00 |
| 11,793,253 | B1 | 10/2023 | Farmer | |
| 2008/0047639 | A1 | 2/2008 | Fox | |
| 2008/0148464 | A1 * | 6/2008 | Chang | A63B 57/353 473/406 |
| 2013/0042387 | A1 | 2/2013 | Kwon | |
| 2013/0276205 | A1 * | 10/2013 | Madore | A42B 1/0182 2/160 |

(Continued)

FOREIGN PATENT DOCUMENTS

| | | | | |
|---|---|---|---|---|
| FR | 2949300 A1 * | 3/2011 | | A41F 1/002 |
| KR | 200351833 Y1 * | 6/2004 | | |

(Continued)

OTHER PUBLICATIONS

English translation of KR 10-20180097233 (Doc pub. Aug. 2018) (Year: 2018).*

*Primary Examiner* — Amy Vanatta
(74) *Attorney, Agent, or Firm* — AdamsIP, LLC; Stephen Christopher Thompson; James Hunter Adams

(57) ABSTRACT

A magnetic golf glove with a ball marker is provided. The glove includes at least three magnets. Two of the magnets form a magnetic closure that secures the glove to the user's hand and wrist. The third magnet forms at least part of the ball marker. The third magnet may be secured to the first magnet to secure the ball marker to the glove for easy access. The ball marker may be detached from the glove for use in marking a location of the user's golf ball. The ball marker may also be secured to any ferromagnetic surface of the glove or any other object.

16 Claims, 6 Drawing Sheets

(56) References Cited

U.S. PATENT DOCUMENTS

| | | | | |
|---|---|---|---|---|
| 2013/0276206 | A1* | 10/2013 | DuChene | A41D 19/0048 2/161.4 |
| 2014/0061261 | A1 | 3/2014 | Yakeley | |
| 2015/0374108 | A1 | 12/2015 | Madore et al. | |
| 2016/0074741 | A1 | 3/2016 | Ramirez | |
| 2016/0367882 | A1* | 12/2016 | Ramirez | A63B 71/141 |

FOREIGN PATENT DOCUMENTS

| | | | | |
|---|---|---|---|---|
| KR | 200374511 | Y1 | * | 1/2005 |
| KR | 20180097233 | A | * | 8/2018 |
| KR | 102428673 | B1 | * | 8/2022 |
| KR | 20220168322 | A | * | 12/2022 |
| WO | 2005/057113 | A1 | | 6/2005 |
| WO | 2010/128689 | A1 | | 11/2010 |
| WO | 2020/111480 | A1 | | 6/2020 |

* cited by examiner

MAGNETIC GOLF GLOVE WITH BALL MARKER

FIELD OF THE INVENTION

The present invention relates generally to a golf glove with a magnetic closure and magnetic ball marker.

BACKGROUND

Golf is a popular sport that requires a variety of equipment, including clubs, balls, tees, and gloves. Golf gloves, in particular, are an important piece of equipment for most golfers. Golf gloves may be worn on both hands but are typically worn at least on the player's non-dominant hand. Golf gloves serve multiple purposes. First, they provide a better grip on the golf club, reducing the chance of the club slipping out of the player's hand. Secondly, they help prevent blisters and calluses that can form due to repeated friction between the player's hand and the golf club. Lastly, gloves can offer warmth in colder weather conditions.

Golf gloves are generally made of leather or synthetic materials and are designed to fit snugly around the golfer's hand. They typically feature an opening for the hand and enclosed pockets for the fingers and thumb. A closure system, often a strap with a fastening mechanism, is typically used to secure the glove around the golfer's wrist. This closure system is usually located on the back of the glove, adjacent to the opening. The fastening mechanism of the closure system can vary. One common type is the hook and loop fastener, also known by the brand name Velcro. This type of fastener is easy to use and allows for some degree of adjustability in the fit of the glove. However, it can wear out over time, reducing its effectiveness. Additionally, the hook and loop fastener can collect dirt and debris, which can further diminish its effectiveness in providing a secure closure.

Another accessory often used by golfers is the ball marker. Ball markers are generally small, flat objects used to mark the position of a golfer's ball on the green when the ball is lifted. Ball markers can be made of various materials, including plastic and metal. Because ball markers are typically small and flat, they are easy to carry and use but also easy to misplace.

SUMMARY

In one aspect, a golf glove is provided. The golf glove comprises a hand-receiving portion, a flap with a magnetic closure designed for enclosing the glove around the golfer's wrist, a magnetic ball marker that can be attached to and detached from the glove, and a ball marker holder configured to magnetically secure the ball marker to an outer surface of the ball marker holder, thereby securing the ball marker to the glove so that the golfer can readily access the ball marker anytime the golfer is wearing the glove. The hand-receiving portion comprises a plurality of finger pockets and has an opening to receive the golfer's hand therein. The hand-receiving portion also has a back side configured to cover the back of the golfer's hand when wearing the glove. A first magnet is secured to the flap, and a second magnet is secured to the back side of the hand-receiving portion. The first and second magnets may be magnetically secured to each other to secure the flap to the back side of the hand-receiving portion, thereby securing the glove to the golfer's hand. The back side of the hand-receiving portion preferably has a slit extending from the opening in a direction toward the finger pockets. The flap is attached to the hand-receiving portion in a position generally adjacent the opening and preferably on a side of the slit opposite the attachment location of the second magnet to the back side.

The ball marker holder may be attached to an outer side of the flap in a position adjacent the first magnet, which is also secured to the flap. The outer surface of the ball marker holder is thus disposed on the outer side of the flap. The magnetic ball marker is configured to be magnetically secured to the first magnet to magnetically secure the ball marker to the outer surface of the ball marker holder. The magnetic material of the ball marker helps to increase the attractive force of the magnetic enclosure when the first and second magnets are joined together with the addition of the magnetic ball marker magnetically joined to the first magnet. The magnetic material of the ball marker also allows the ball marker to be independently secured to any ferromagnetic material that is not part of the glove so that the ball marker may be secured either to the glove or to any other convenient metallic structure, such as a metal portion of a golf club or a golf cart.

In a preferred embodiment, the ball marker holder comprises a retaining wall configured to at least partially surround the outer surface of the ball marker holder to which the ball marker is magnetically secured. Both the ball marker and the retaining wall preferably have a generally circular shape sized so that the ball marker fits within the retaining wall. The retaining wall may include a cutout portion to allow easy removal of the ball marker from the ball marker holder.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
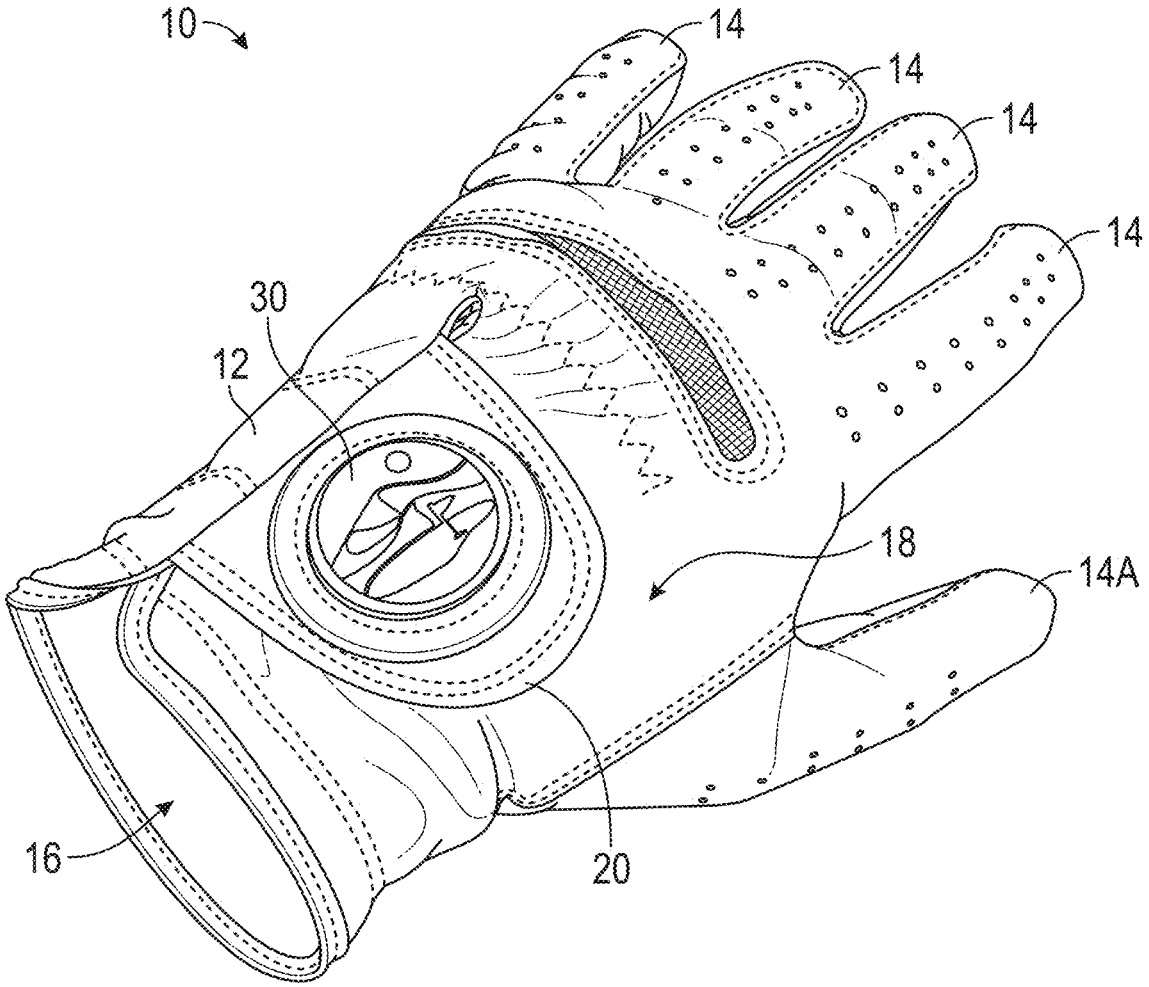
FIG. 1 shows a perspective view of a golf glove with a ball marker in accordance with the present disclosure.
Figure 2:
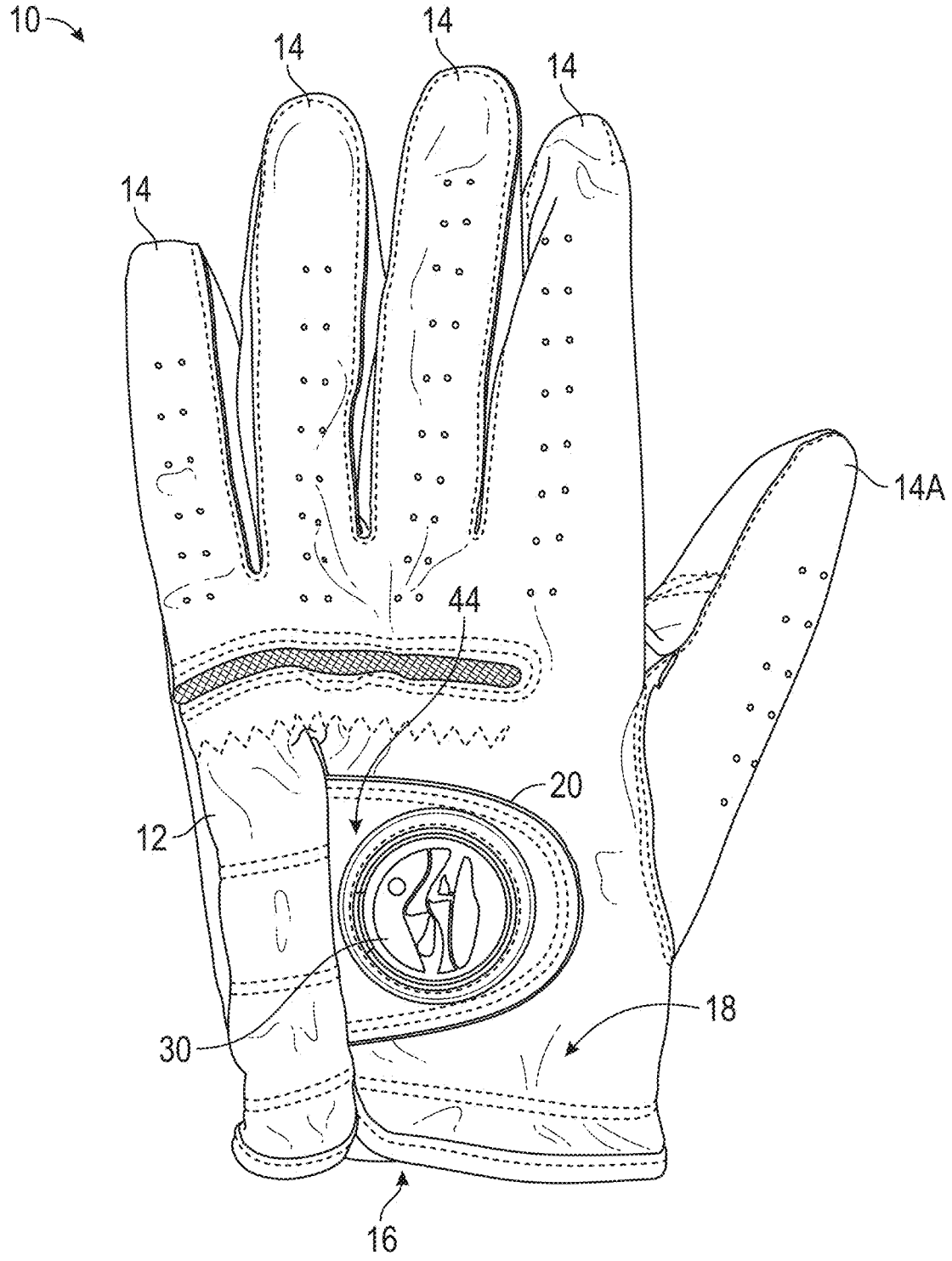
FIG. 2 shows a top perspective view of a golf glove with a ball marker in accordance with the present disclosure.
Figure 3:
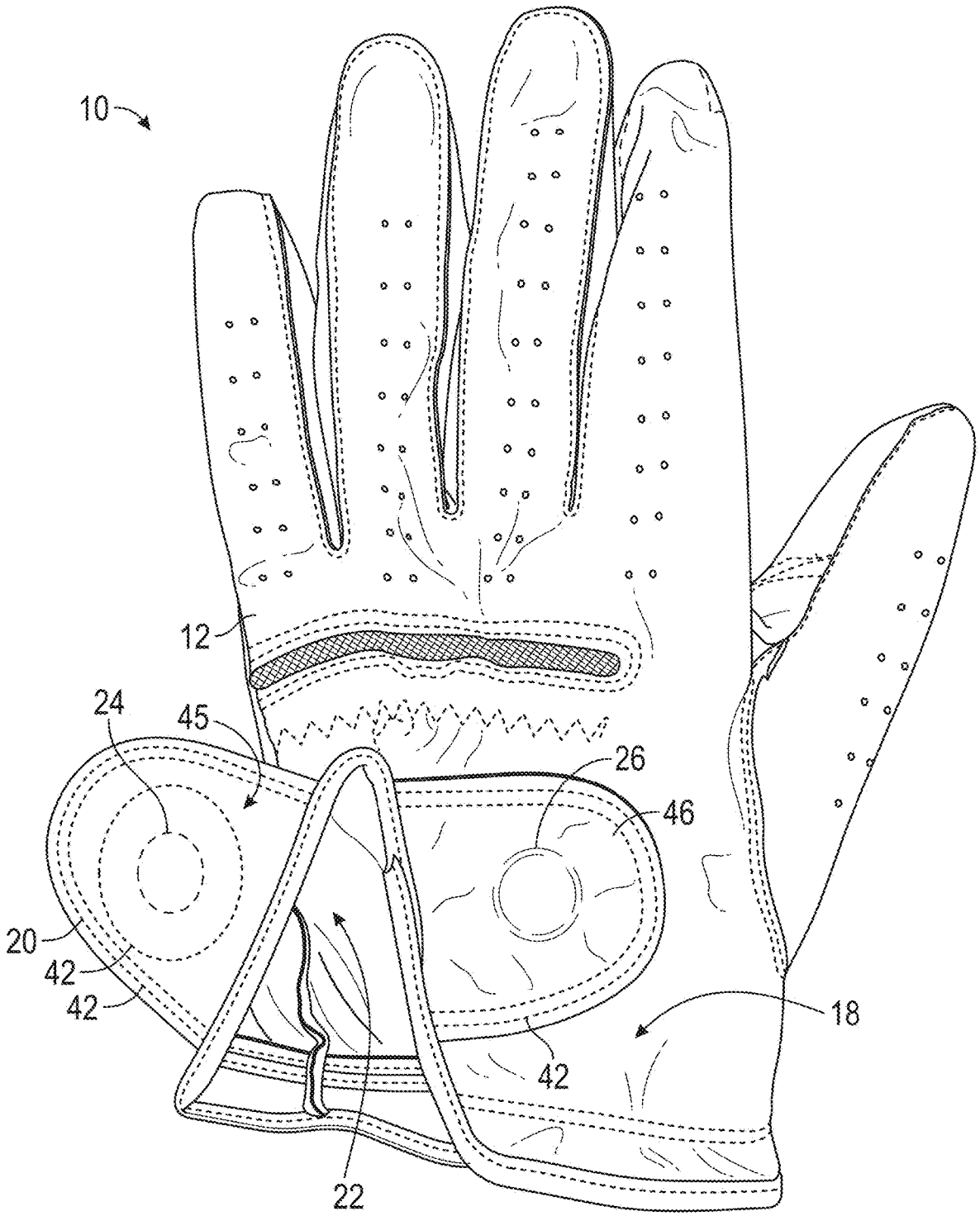
FIG. 3 shows a top perspective view of a golf glove with a magnetic closure in an open configuration in accordance with the present disclosure.

In one aspect, a golf glove 10 is provided. FIGS. 1-6 illustrate preferred embodiments of the glove 10 or components thereof. The golf glove 10 comprises at least three magnets and has a magnetic closure for securing the glove 10 to the user's hand and wrist. The first magnet 24 and second magnet 26 form part of the magnetic closure and can be magnetically joined together to secure the closure. The third magnet 28 forms at least part of a ball marker 30 that can be detached from the golf glove 10 and then used to mark the position of the golfer's ball on the green when the ball is lifted. The third magnet 28 can be magnetically secured to the first magnet 24 to secure the ball marker 30 to the glove 10. When the first magnet 24 and the second magnet 26 are joined together to secure the closure, the third magnet 28 can be secured to the first magnet 24 to increase the attractive force of the magnetic enclosure. The third magnet 28 also allows the ball marker 30 to be independently secured to any ferromagnetic material that is not part of the glove 10. This allows the ball marker 30 to be secured either to the glove 10 or to any other convenient metallic surface, such as a metal portion of a golf club or golf cart. FIGS. 1 and 2 show the magnetic closure in a closed configuration with the first magnet 24 joined to the second magnet 26 as the glove 10 would be worn by the user. FIG. 3 shows the magnetic closure in an open configuration for donning the glove 10 or removing the glove 10 from the user's hand.

As best seen in FIG. 1, the golf glove 10 comprises a hand-receiving portion 12 having an opening 16 configured to receive a hand of a user. The hand-receiving portion 12 further comprises a plurality of finger pockets 14 for each of the use's fingers, one of which is preferably a thumb pocket 14A. The finger pockets 14 are preferably completely enclosed so that each pocket 14 entirely covers each of the user's fingers, though the pockets 14 may optionally have open fingertip sections. The hand-receiving portion 12 and/or finger pockets 14 preferably also include small holes or mesh-covered areas to allow some air flow between the interior and exterior of the glove 10. The hand-receiving portion 12 also has a back side 18 configured to cover a back of the hand of the user when the user has donned the glove 10 by placing his or her hand and fingers into the hand-receiving portion 12 and finger pockets 14.

The golf glove 10 further comprises a flap 20 attached to the hand-receiving portion 12 in a position generally adjacent the opening 16, as shown in FIG. 2. The flap 20 and back side 18 of the hand-receiving portion generally form the structure of the magnetic closure, which is designed for enclosing at least portions of the glove 10 around the user's hand and/or wrist. The first magnet 24 is secured to the flap 20, and the second magnet 26 is secured to the back side 18 of the hand-receiving portion 12, as best seen in FIG. 3. The first magnet 24 and the second magnet 26 are configured to magnetically secure the flap 20 to the back side 18 of the hand-receiving portion 12 to secure the glove 10 to the user's hand. In a preferred embodiment, the back side 18 of the hand-receiving portion 12 has a slit 22 extending from the opening 16 in a direction toward the finger pockets 14, as best seen in FIG. 3. The flap 20 is preferably secured to the back side 18 of the hand-receiving portion 12 on a side of the slit 22 opposite the second magnet 26.

Figure 4:
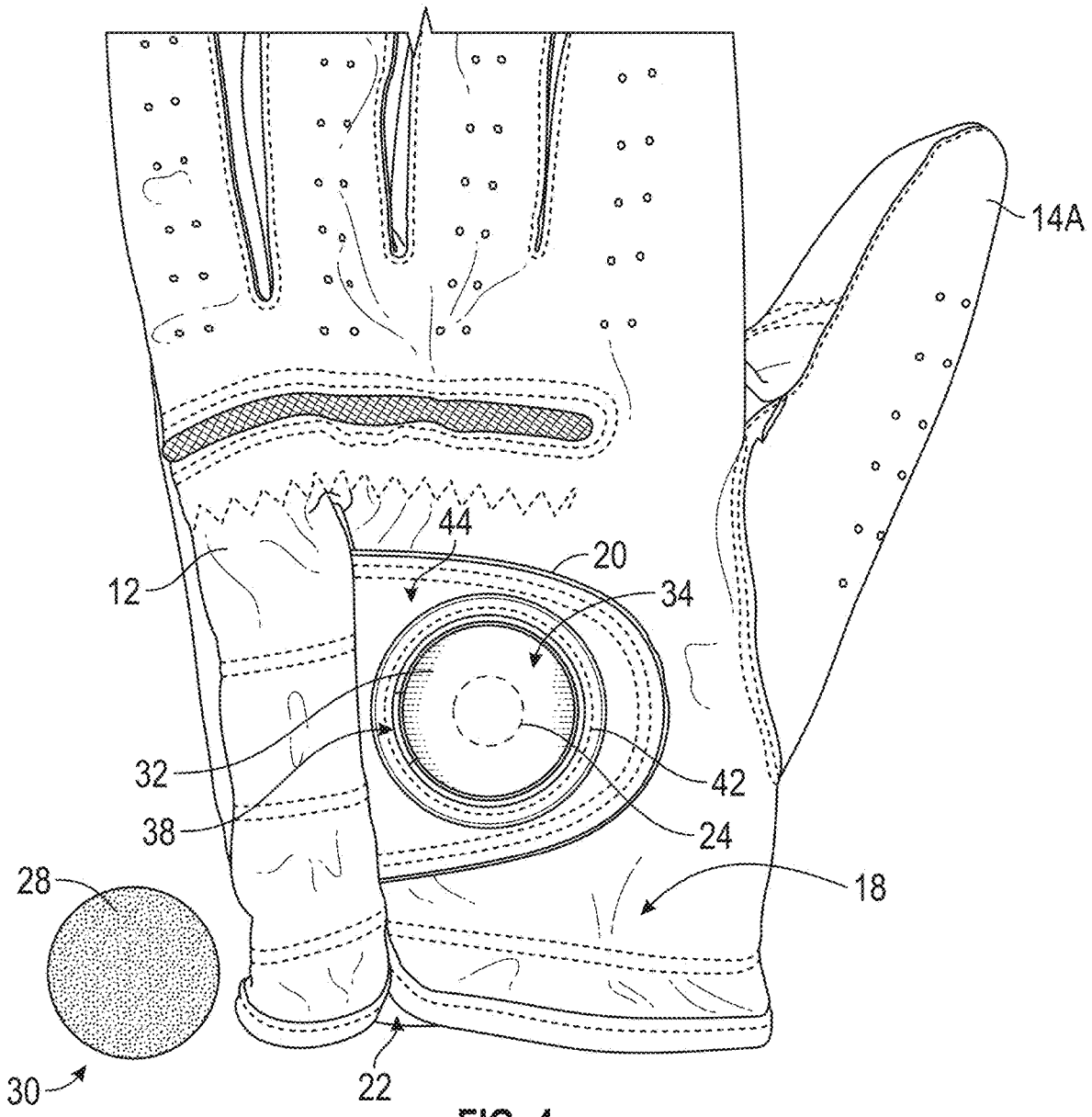
FIG. 4 shows a partial perspective view of a golf glove with a ball marker removed from the glove in accordance with the present disclosure.

The golf glove 10 further comprises a ball marker 30 comprising a third magnet 28. The ball marker 30 can be magnetically secured to and detached from the glove 10. FIGS. 1 and 2 show the ball marker 30 magnetically secured to the glove 10, and FIG. 4 shows the ball marker 30 detached from the glove 10. The golf glove 10 further comprises a ball marker holder 32 attached to the flap 20 in a position adjacent the first magnet 24. The ball marker holder 32 has an outer surface 34 disposed on an outer side 44 of the flap 20 when the flap 20 is secured to the back side 18 of the hand-receiving portion 12, as shown in FIG. 4. The first magnet 24 and the third magnet 28 are configured to magnetically secure the ball marker 30 to the outer surface 34 of the ball marker holder 32.

Figure 5:
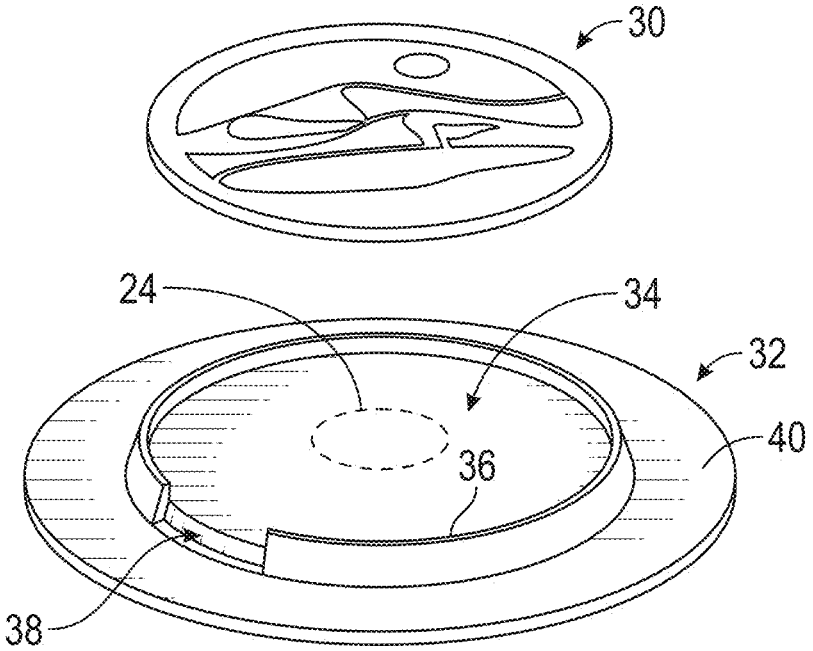
FIG. 5 shows a perspective view of a ball marker detached from a magnet ball marker holder in accordance with the present disclosure.

FIG. 5 shows a detailed view of the ball marker 30 and the ball marker holder 32 detached from the glove 10 with the ball marker 30 removed from the holder 32 to illustrate components of the ball marker 30 and holder 32. The ball marker 30 preferably comprises a thin planar disc having a circular shape suitable for use marking a golf ball on a golf course green. The third magnet 28 may be embedded within or otherwise attached to the ball marker 30 to allow magnetic attachment of the ball marker 30 to any ferromagnetic surface, or the entirety of the ball marker 30 may optionally be formed with a ferromagnetic material. In one preferred embodiment, as best seen in FIG. 4, one side of the ball marker 30 that directly contacts the outer surface 34 of the holder 32 has a generally plain surface without decorative features. The plain surface may optionally be textured. In another preferred embodiment, as best seen in FIGS. 1 and 5, an opposite side of the ball marker 30 that faces outwardly when the ball marker 30 is secured to the holder 32 has a decorative surface depicting a logo or other ornamental design.

In a preferred embodiment, as best seen in FIG. 5, the ball marker holder 32 comprises a retaining wall 36 configured to at least partially surround the outer surface of the ball marker holder 32 to which the ball marker 30 is magnetically secured. The retaining wall 36 preferably has a generally circular shape that generally corresponds to the circular shape of the ball marker 30 so that the ball marker 30 fits within the retaining wall 36 with minimal space between the ball marker 30 and the retaining wall 36, as best seen in FIG. 2.

In a preferred embodiment, as best seen in FIG. 5, the retaining wall 36 also has a cutout portion 38 configured to allow removal of the ball marker 30 from the ball marker holder 32. The cutout portion 38 is generally a discontinuation in the retaining wall 36 that allows a user to apply a small amount of force or leverage to the ball marker 30 with the user's fingers at the cutout portion 38 to manually separate the ball marker 30 from the first magnet 24 holding the ball marker 30 in place. In a preferred embodiment, the ball marker holder 32 comprises a peripheral portion 40 surrounding the retaining wall 36 on a periphery of the holder 32 outside of the area of the outer surface 34 that contacts the ball marker 30. To attach the ball marker holder 32 to the flap 20 of the glove 10, as best seen in FIG. 4, the peripheral portion 40 may be covered with textile material on the outer side 44 of the flap 20 of the glove 10, and the textile material may then be sewn onto the peripheral portion 40 to produce stitching 42 extending around the exterior of the retaining wall 36. As shown in FIG. 3, stitching 42 may also be used on the inner side 45 of the flap 20 to attach a bottom side of the ball marker holder 32 to the flap 20 to secure the holder 32 in a generally fixed position relative to the flap 20. As used herein, a "textile" or "textile material" may refer to any natural or synthetic material that is pliable and thus generally suitable for use in manufacturing a glove or other article of clothing and may include woven or non-woven fabrics or other fiber-based materials or other similarly pliable materials such as leather.

In a preferred embodiment, the cutout portion 38 of the retaining wall 36 is disposed on a side of the ball marker holder 32 opposite the thumb pocket 14A, as best seen in FIG. 4. This allows the user to easily use his or her opposite hand to remove the ball marker 30 from the holder 32. FIGS. 1-4 illustrate a glove 10 for a user's left hand. Thus, the user may use his or her right hand to reach across the outer side 44 of the glove 10 to an opposing side of the holder 32 and lift the ball marker 30 from the holder 32 at the cutout portion 38.

In a preferred embodiment, as best seen in FIG. 5, the outer surface 34 of the holder 32 may be defined by a generally flat piece of material having an edge that is slightly raised above an upper surface of the peripheral portion 40. This raised edge may allow the user to more easily lift the ball marker 30 from the holder 32 at the cutout portion 38 of the retaining wall 36. In a preferred embodiment, the first magnet 24 may be disposed under the piece of material forming the outer surface 34. In this embodiment, the first magnet 24 may be sandwiched between the piece of material forming the outer surface 34 and textile material forming the inner side 45 of the flap 20, as generally indicated by the dashed lines shown in FIGS. 3 and 5. The first magnet 24 may be secured to an inner or bottom side of the material forming the outer surface 34 to hold the first magnet 24 in a fixed position relative to the holder 32. Alternatively, the first magnet 24 may be embedded within or otherwise attached to the material forming the outer surface 34, or the entirety of the material forming the outer surface 34 may optionally be formed with a ferromagnetic material to function as the first magnet 24.

The second magnet 26 is preferably disposed within a cavity or pocket 46 formed within the back side 18 of the hand-receiving portion 12, as best seen in FIG. 3. The pocket 46 may be formed by two layers of textile material attached by stitching 42. The second magnet 26 may be stitched or otherwise attached to one or both of the two layers forming the pocket 46 to retain the second magnet 26 in a generally fixed position within the pocket 46. In a preferred embodiment, the second magnet 26 is attached to both layers forming the pocket 46 to bind the two layers together. Each of the two layers is preferably made of leather. Similarly, the first magnet 24 and/or at least portions of the ball marker holder 32 may be disposed within a pocket formed within the flap 20. The pocket within the flap 20 may be defined by the textile material forming the outer side 44 and the inner side 45 of the flap 20. The material forming both layers is preferably leather. The first magnet 24 and/or at least portions of the ball marker holder 32 may also be stitched or otherwise attached to both layers forming the pocket in the flap 20 to bind the two layers together. By attaching each of the first magnet 24 and the second magnet 26 to two opposing layers formed by pockets within the flap 20 and within the back side 18 of the glove 10, respectively, to retain both magnets 24 and 26 in a generally fixed position, the positioning of the magnets 24 and 26 helps of facilitate automatic alignment of the flap 20 during each use, thereby ensuring a consistent and precise fit of the glove 10 to the user's hand and wrist area.

Figure 6:
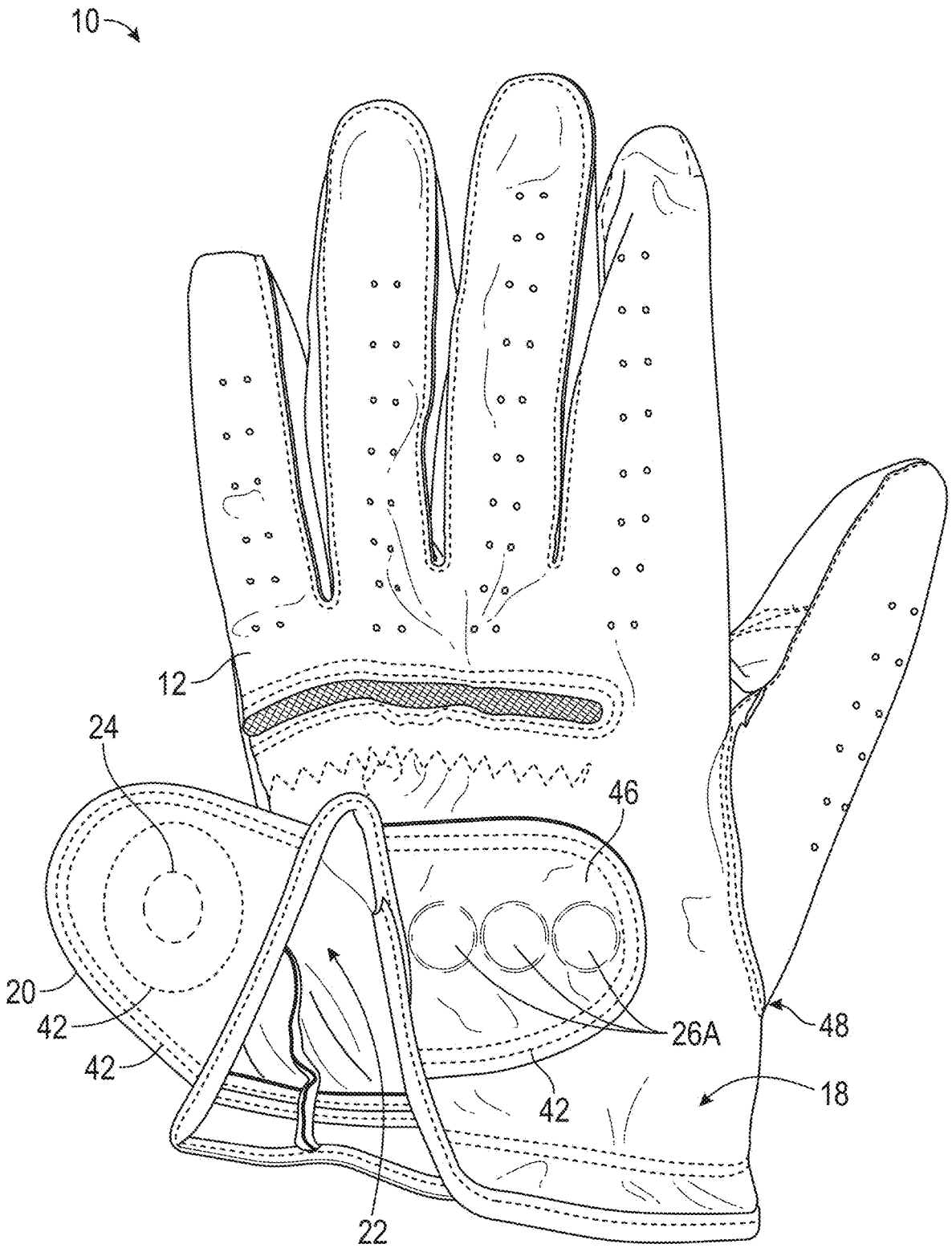
FIG. 6 shows a perspective view of an alternative embodiment of a golf glove with a ball marker in accordance with the present disclosure.

In an alternative embodiment, as shown in FIG. 6, the second magnet 26 may comprise a plurality of individual magnets 26A each secured to the back side 18 of the hand-receiving portion 12. The plurality of individual magnets 26A are disposed in a position in which the individual magnets 26A are aligned in a generally lateral direction across the back side 18 of the hand-receiving portion 12 and extending from the slit 22 toward a lateral edge 48 of the glove 10. As used herein, a "lateral direction" refers to a direction extending across the back of a user's hand in a direction generally perpendicular to the user's forearm when the user's hand is held out straight. By providing multiple individual magnets 26A, the first magnet 24 may be magnetically joined to any one of the individual magnets 26A to more tightly or more loosely secure the glove 10 to the user's hand, depending on the size of the user's hand and/or the user's preference. Each of the individual magnets 26A may be stitched or otherwise attached to one or both of the two layers forming the pocket 46 to retain each of the individual magnets 26A in a generally fixed position within the pocket 46. In an alternative embodiment, the plurality of magnets 26A may comprise a single elongated magnet extending in a lateral direction within the pocket 46 so that the location of securing the closure may be changed to adjust the fit of the glove 10 around the user's hand and/or wrist.

In another aspect, a method of using a golf glove 10 is provided. To don the glove 10, the user first inserts his or her hand into the opening 16 of the hand-receiving portion 12 so that user's fingers are disposed within each of the plurality of finger pockets 14, 14A and the back side 18 of the hand-receiving portion 12 is covering the back of the user's hand. The user then magnetically secures the flap 20 to the back side 18 of the hand-receiving portion 12 to secure the glove 10 to the user's hand by magnetically securing the first magnet 24 to the second magnet 26. The user then magnetically secures the ball marker 30 to the outer surface 34 of the ball marker holder 32 by magnetically securing the third magnet 28 to the first magnet 24. In a preferred embodiment, magnetically securing the ball marker 30 to the outer surface 34 of the ball marker holder 32 comprises placing the ball marker 30 against the outer surface 34 of the ball marker holder 32 in a position in which the retaining wall 36 at least partially surrounds the ball marker 30. When needed, the user may then remove the ball marker 30 from the ball marker holder 32 by lifting the ball marker 30 away from the outer surface 34 of the ball marker holder 32 through the cutout portion 38 of the retaining wall 36.

The magnetic material of the ball marker 30 helps to increase the attractive force of the magnetic enclosure when the first magnet 24 and second magnet 26 are joined together with the addition of the third magnet 28 of the ball marker 30 magnetically joined to the first magnet 24. The third magnet 28 of the ball marker 30 also allows the ball marker 30 to be independently secured to any ferromagnetic material that is not part of the glove 10 so that the ball marker 30 may be secured to any ferromagnetic material, including the first magnet 24 that is attached to the glove 10.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A glove comprising:

a hand-receiving portion comprising a plurality of finger pockets and having an opening configured to receive a hand of a user, wherein the hand-receiving portion has a back side configured to cover a back of the hand of the user;

a flap attached to the hand-receiving portion in a position generally adjacent the opening;

a first magnet embedded within the flap and a second magnet embedded within the back side of the hand-receiving portion, wherein the first magnet and the second magnet are configured to magnetically secure the flap to the back side of the hand-receiving portion to secure the glove to the hand of the user;

a ball marker holder attached to an outer side of the flap, wherein the ball marker holder is positioned above the first magnet on the outer side of the flap, wherein the ball marker holder has an outer surface disposed on the outer side of the flap, wherein textile material of said outer side of said flap is disposed between said first magnet and said outer surface; and a ball marker comprising a third magnet, wherein the first magnet and the third magnet are configured to magnetically secure the ball marker to the outer surface of the ball marker holder.

2. The glove of claim 1, wherein the ball marker comprises a thin planar disc.

3. The glove of claim 1, wherein the ball marker holder comprises a retaining wall configured to at least partially surround the outer surface of the ball marker holder.

4. The glove of claim 3, wherein the retaining wall has a generally circular shape.

5. The glove of claim 3, wherein the retaining wall has a cutout portion configured to allow removal of the ball marker from the ball marker holder.

6. The glove of claim 5, wherein the cutout portion of the retaining wall is disposed on a side of the ball marker holder opposite a thumb pocket.

7. The glove of claim 1, wherein the back side of the hand-receiving portion has a slit extending from the opening in a direction toward the finger pockets, wherein the flap is secured to the back side of the hand-receiving portion on a side of the slit opposite the second magnet.

8. The glove of claim 7, wherein the second magnet comprises a plurality of individual magnets each secured to the back side of the hand-receiving portion, wherein the plurality of individual magnets are disposed in a position in which the individual magnets are aligned in a generally lateral direction across the back side of the hand-receiving portion and extending from the slit toward a lateral edge of the glove.

9. A method of using a glove comprising the steps of:

providing a glove comprising:

a hand-receiving portion comprising a plurality of finger pockets and having an opening configured to receive a hand of a user, wherein the hand-receiving portion has a back side configured to cover a back of the hand of the user, a flap attached to the hand-receiving portion in a position generally adjacent the opening, a first magnet embedded within the flap and a second magnet embedded within the back side of the hand-receiving portion, wherein the first magnet and the second magnet are configured to magnetically secure the flap to the back side of the hand-receiving portion to secure the glove to the hand of the user, a ball marker holder attached to an outer side of the flap, wherein the ball marker holder is positioned above the first magnet on the outer side of the flap, wherein the ball marker holder has an outer surface disposed on the outer side of the flap, wherein textile material of said outer side of said flap is disposed between said first magnet and said outer surface; and a ball marker comprising a third magnet, wherein the first magnet and the third magnet are configured to magnetically secure the ball marker to the outer surface of the ball marker holder;

inserting a hand of a user into the opening so that fingers of the user are disposed within each of the plurality of finger pockets and the back side of the hand-receiving portion is covering the back of the hand of the user;

magnetically securing the flap to the back side of the hand-receiving portion to secure the glove to the hand of the user by magnetically securing the first magnet to the second magnet; and magnetically securing the ball marker to the outer surface of the ball marker holder by magnetically securing the third magnet to the first magnet.

10. The method of claim 9, wherein the ball marker comprises a thin planar disc.

11. The method of claim 9, wherein the ball marker holder comprises a retaining wall configured to at least partially surround the outer surface of the ball marker holder, wherein the step of magnetically securing the ball marker to the outer surface of the ball marker holder comprises placing the ball marker against the outer surface of the ball marker holder in a position in which the retaining wall at least partially surrounds the ball marker.

12. The method of claim 11, wherein the retaining wall has a generally circular shape.

13. The method of claim 11, wherein the retaining wall has a cutout portion configured to allow removal of the ball marker from the ball marker holder, wherein the method further comprises the step of removing the ball marker from the ball marker holder by the user lifting the ball marker away from the outer surface of the ball marker holder through the cutout portion.

14. The method of claim 13, wherein the cutout portion of the retaining wall is disposed on a side of the ball marker holder opposite a thumb pocket.

15. The method of claim 9, wherein the back side of the hand-receiving portion has a slit extending from the opening in a direction toward the finger pockets, wherein the flap is secured to the back side of the hand-receiving portion on a side of the slit opposite the second magnet.

16. The method of claim 15, wherein the second magnet comprises a plurality of individual magnets each secured to the back side of the hand-receiving portion, wherein the plurality of individual magnets are disposed in a position in which the individual magnets are aligned in a generally lateral direction across the back side of the hand-receiving portion and extending from the slit toward a lateral edge of the glove, wherein the step of magnetically securing the flap to the back side of the hand-receiving portion to secure the glove to the hand of the user comprises magnetically securing the first magnet to any one of the individual magnets each secured to the back side of the hand-receiving portion.

* * * * *